US005997043A

United States Patent [19]

Dahlquist

[11] Patent Number: 5,997,043

[45] Date of Patent: Dec. 7, 1999

[54] MULTI-PANEL BROCHURE AND METHOD OF BROCHURE MANUFACTURE

[75] Inventor: Ake L. Dahlquist, Dixon, Ill.

[73] Assignee: Sleepeck Printing Company D/B/A/ Dixonweb Printing Company, Dixon, Ill.

[21] Appl. No.: 09/093,370

[22] Filed: Jun. 8, 1998

[51] Int. Cl.[6] ..... B42D 15/00

[52] U.S. Cl. ..... 283/63.1; 283/61; 283/56; 281/3.1

[58] Field of Search ..... 281/2, 5, 29, 3.1, 281/15.1, 38; 285/61, 62, 63.1, 64, 67, 56

[56] References Cited

U.S. PATENT DOCUMENTS

| | | | |
|---|---|---|---|
| 5,454,644 | 10/1995 | Augustin | 281/5 X |
| 5,634,667 | 6/1997 | Jordan | 281/29 |
| 5,873,513 | 2/1999 | Ong | 281/29 |
| 5,893,586 | 4/1999 | McGuire | 281/2 X |

*Primary Examiner*—Willmon Fridie, Jr.
*Attorney, Agent, or Firm*—Banner & Witcoff, Ltd.

[57] ABSTRACT

A multiple panel brochure includes an outside carrier sheet folded to provide three equal sized panels wherein a middle panel of the carrier sheet includes separate interior panels affixed thereto. The outside panels of the carrier sheet fold over the interior panels and one another. A method for manufacture of the brochure is disclosed utilizing a web printed on one or both sides and which is subsequently cut to form the panels that are then joined together.

32 Claims, 5 Drawing Sheets

FIG.6
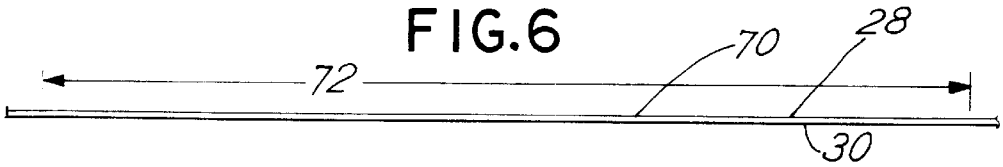
FIG.7
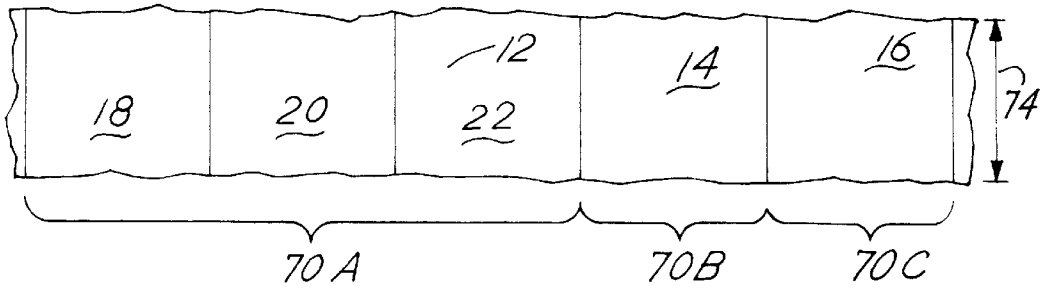
FIG.8
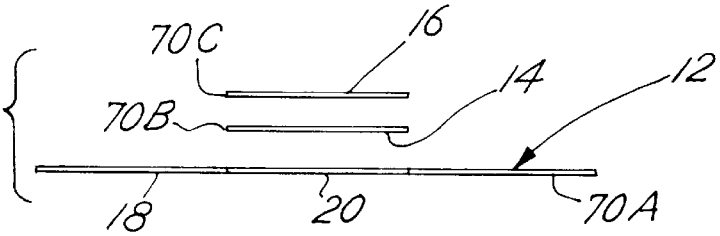
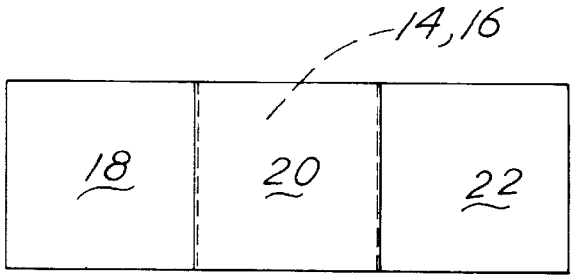
FIG.9

FIG.15
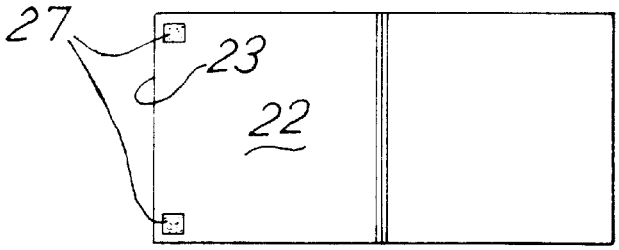
FIG.16
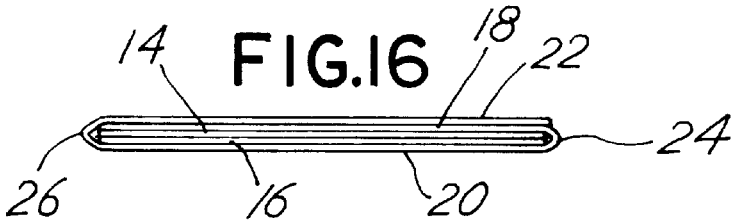
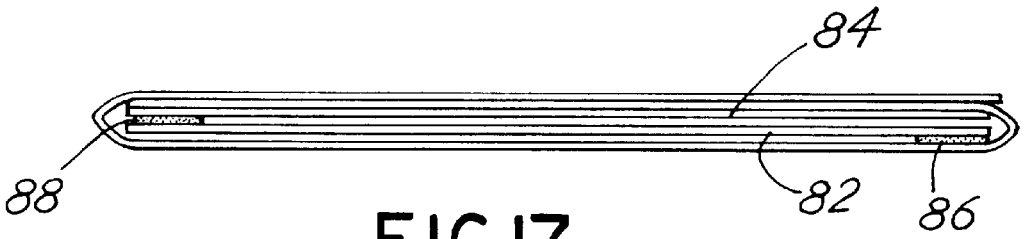
FIG.17
FIG.18
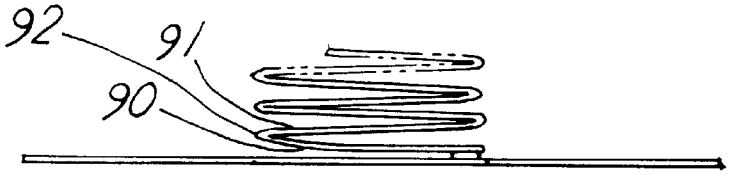

MULTI-PANEL BROCHURE AND METHOD OF BROCHURE MANUFACTURE

BACKGROUND OF THE INVENTION

This invention relates to a multi-panel brochure of the type which may be distributed as promotional literature, for example, by mailing and a method for manufacture of such a brochure.

Multiple panel brochures are often used for advertisement of products and services and are distributed by direct mail, as inserts in newspapers, magazines, and the like, and by direct distribution. It is desirable to have such brochures printed with multicolor printing and, on occasion, to provide internal coupons or panels which may be removed for use by the ultimate consumer for redemption, ordering product or for other purposes. Such brochures may also be used as a mailer, or may be merely distributed at a point of purchase outlet.

Brochures of this nature are typically made from paper which has been printed on one or both sides, and then folded with fold lines and score lines positioned to enhance the folding and to promote the utility of the brochure, mailer, or the like. Various prior art patents teach and disclose brochures and envelopes of this general nature, including the following:

| Patent No. | Title |
|---|---|
| 572,488 | Envelope |
| 893,202 | Combined Manifolding Bill and Envelop |
| 1,043,243 | Advertising Device |
| 1,064,302 | Envelope |
| 1,768,164 | Envelope |
| 2,159,486 | Philatelic Device |
| 2,362,496 | Double Post Card and Return Envelope |
| 2,840,295 | Envelope |
| 2,858,061 | Bank By Mail Envelope |
| 4,411,643 | Double Envelope and Method of Making Same |
| 5,169,060 | Direct and Return Mailing Unit |
| 5,603,529 | Color Brochure With Integral Return Mailer and Method of Making It |

While such prior art mailers, brochures, and the like have proven to be utilitarian and useful, there has remained a need for a multiple panel brochure with printing on one or both sides, which may be folded to protect interior coupons or printed panels adhered and maintained within the brochure, and which may be assembled from a continuously moving printed web wherein the component parts are printed and subsequently assembled in a single, continuous, high speed process.

A requisite for products of this general nature is that the brochure be unique and unusual in order to attract the attention of a likely consumer. Thus, such brochures or promotional items may have unique shapes, unique coloring, unique assembly, or combinations thereof. By utilizing an unusual or unique product, and gaining consumer attention, one seeks to, and typically does, increase the rate of positive response to the promotional effort represented by the brochure. Thus, there has developed a general objective, with respect to such brochures, of seeking a promotional brochure or product which enhances consumer response.

SUMMARY OF THE INVENTION

Briefly, the present invention comprises a multiple panel brochure which includes an outside carrier sheet defined by three generally equally sized, side by side panels. One side panel of the carrier sheet folds over the center panel and the other side panel folds over both the one side panel and the center panel. The side or outer panels also fold over at least one interior panel which is attached to the center or middle panel of the carrier sheet. Two or more interior panels may be attached in a layered sequence to the center or middle panel. Multiple interior panels comprise discrete layered panels, or pages, adhered or connected to one another, for example, by gluing the interior panels together with adhesive along alternate edges, such as the head or top edge and foot or bottom edge. The interior panels may include perforation lines to permit separation of the panels from the brochure, or to enhance the ability to fold the interior panels or pages. The layered interior panels may also be fabricated from a single sheet folded in an accordion pattern.

The invention further contemplates that the brochure may be manufactured from a single printed web wherein a first longitudinal portion of the web comprises the printed carrier sheet and another second longitudinal portion of the same web comprises a printed, interior panel. Third, fourth, etc. longitudinal portions of the same web may comprise further printed interior panels. Thus, the web (comprised of a carrier sheet section and one or more interior panel sections) may be printed on one or both sides. Adhesive may then be placed at strategic positions on the web sections. The web may then be cut longitudinally to separate the carrier sheet section and panel sections. The carrier sheet section and panel sections may subsequently be assembled and folded, and then separated from one another by lateral cuts into individual brochures.

Various other features may be incorporated in the brochures. The interior panels, for example, may be attached to the carrier sheet along any one of four edges of the interior panel, i.e. the head, foot, face or spine edges. Additionally, the particular shape of the carrier sheet, as well as the interior panels may be modified or adjusted. Thus, a square or rectangular shaped interior panel and/or carrier sheet may be adapted. Consequently, panel shape is not a limiting feature of the invention.

Thus, it is an object of the invention to provide an improved brochure construction which includes a three (or more) panel carrier sheet with interior panels adhered to or otherwise attached to the center panel of the multiple panel carrier sheet.

Yet, another object of the invention is to provide an improved brochure which may be used for point of sales distribution, mailing or other means of distribution.

Another object of the invention is to provide an improved brochure which may be fabricated by printing on a single web of material and thereafter cutting the web into various longitudinal sections, or portions, which may be assembled to form the brochure.

Another object of the invention is to provide an improved brochure which is economical to manufacture, economical to assemble, and which can be manufactured using available, high speed, printing equipment.

A further object of the invention is to provide an improved brochure having a configuration which is unique and which is designed to attract consumer attention and response.

Another object of the invention is to provide a brochure comprising a three, side by side panel carrier sheet having two or more overlying interior panels positioned on the center panel of the carrier sheet with consecutive interior panels joined alternately at the head or foot to the next adjacent, overlying interior panel.

Yet another object of the invention is to provide a method for manufacture of brochures of the type described.

These and other objects, advantages, and features of the invention will be set forth in the Detailed Description which follows.

BRIEF DESCRIPTION OF THE DRAWING

In the detailed description which follows reference will be made to the drawing comprised of the following figures:

FIG. 6 is an end view of a continuous web which is printed as a first step in the manufacture of a brochure of the type depicted in FIG. 1;

FIG. 7 is a top plan view of the web of FIG. 6;

FIG. 8 is a schematic view representing a further step in the manufacture of a brochure of the type shown in FIG. 1 subsequent to the printing step depicted in FIG. 7 depicting the overlay of the sheet and panels forming the brochure;

FIG. 9 is a schematic plan view illustrating a subsequent step to that of FIG. 8 in the manufacture of the brochure of the invention;

FIG. 15 is a schematic view illustrating a step subsequent to the step of FIG. 14 depicting the application of adhesive on an outside carrier sheet panel;

FIG. 16 is a schematic view illustrating a step subsequent to the step of FIG. 15 depicting a further folding sequence of panels;

FIG. 17 is a cross sectional view of an alternative brochure construction wherein adhesive is provided on alternate side edges of the interior panels rather than the top and bottom edges; and FIG. 18 is a cross sectional view of another alternative brochure wherein the interior panels comprise a sheet folded in an accordion pattern.

DESCRIPTION OF THE PREFERRED EMBODIMENT

Figure 1:
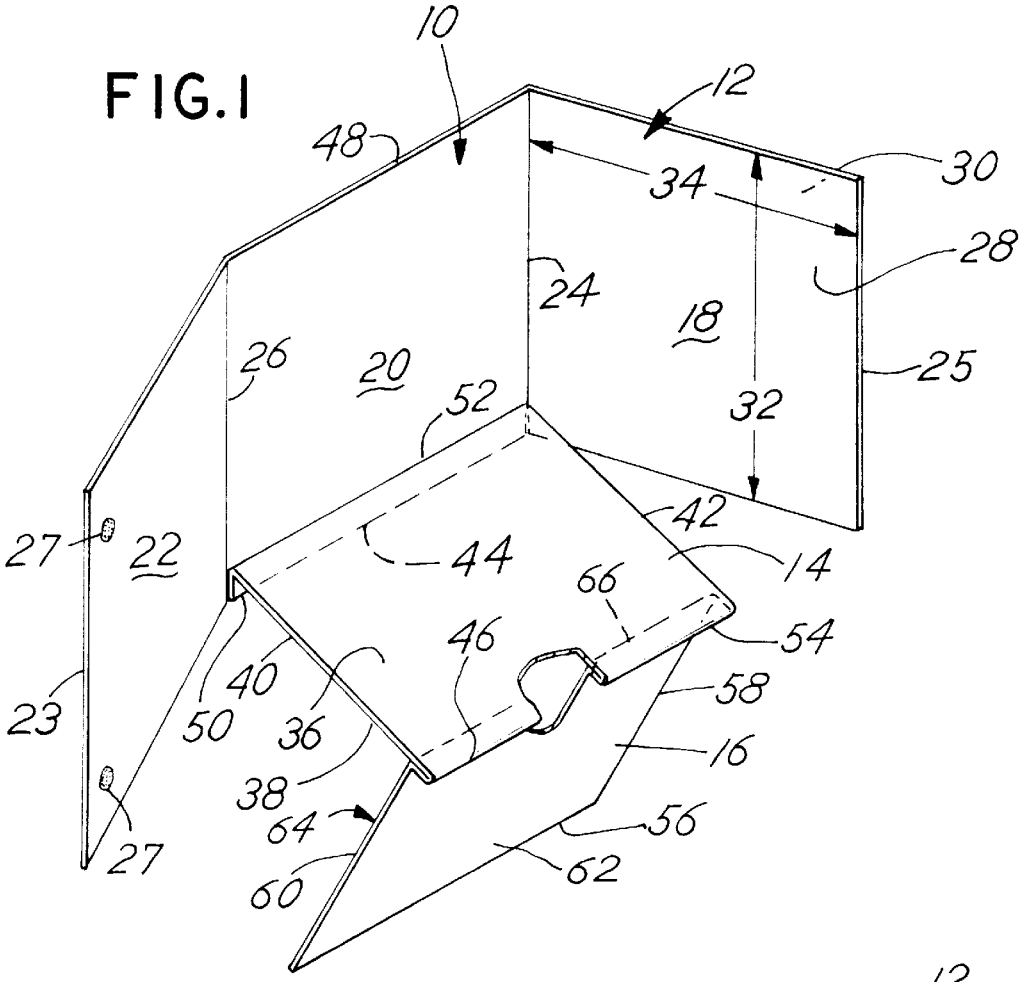
FIG. 1 is an isometric view of a first embodiment of the invention.
Figure 2:
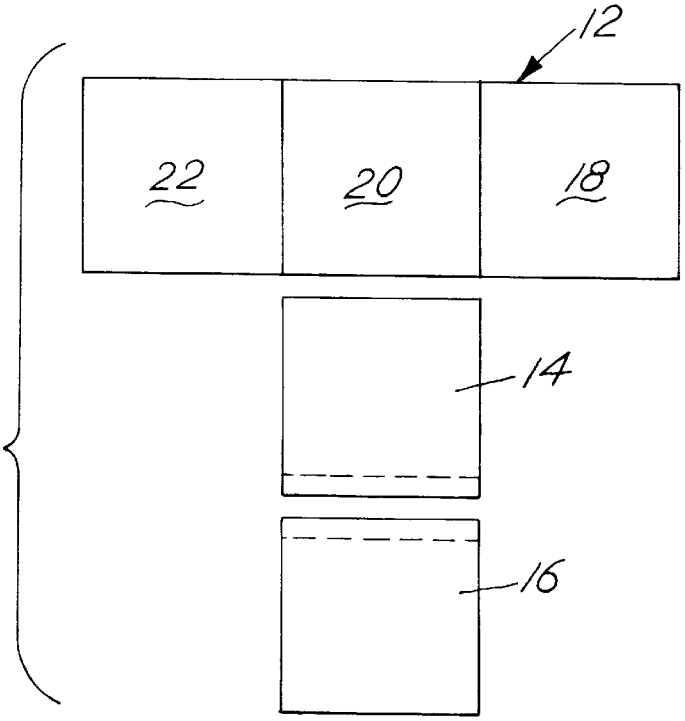
FIG. 2 is a plan view of the component sheets and panels forming the brochure of FIG. 1.

FIG. 1 illustrates an embodiment of the invention made in accord with the method of the invention. Thus, FIG. 1 depicts, in an isometric view, a brochure 10, comprising a carrier sheet 12 having affixed, overlying, interior panels 14 and 16. The carrier sheet 12 is subdivided into three separate panels, namely, a first outside panel 18, a second center or middle panel 20, and a third outside panel 22. Pairs of adjacent carrier sheet panels 18 and 20, and 20 and 22 are joined together along fold lines 24 and 26, respectively. The fold lines 24 and 26 may be scored or unscored. Outside panel 22 includes an outside edge 23 generally parallel to fold lines 24 and 26. Outside panel 18 includes an outside edge 25 generally also parallel to fold lines 24 and 26. The carrier sheet 12 further includes a top surface or side 28 and a bottom surface or side 30. In the embodiment depicted, the first, second and third carrier sheet panels 18, 20, 22 are of equal dimension and have a rectangular shape. The panel dimensions and form, however, are not a limitation to the invention and are set forth for purposes of illustration as being equal. Thus, an outside panel 18 has a height 32 and a width 34. The second or center panel 20 and the third outside panel 22 also have a height and width. The widths of the panels 18, 20, 22, as well as the heights, are equal or generally equal.

The first panel 18 is connected to, and adjacent to, the second panel 20, the connection being provided along the fold line 24. The third panel 22 likewise is connected to the center, middle or second panel 20 along fold line 26.

The first interior panel 14 is, in the embodiment depicted, formed having a height and width substantially or generally equal to height and width of the first, second and third panels 18, 20 and 22. The first interior panel 14 includes a bottom surface or side 36, a top surface or side 38, opposite side edges 40 and 42, a lower edge 44, and an upper edge 46. The second or center panel 20 of the carrier sheet 12 similarly includes an upper edge 48 and a lower edge 50. The lower edge 50 of the second panel 20 is joined to the lower edge 44 of the first interior panel 14. Attachment or joining of the lower edges 44 and 50 may be effected by adhesive or any other means for affixing the material forming the panels 14, 20 together. Typically, the material forming the brochure is a paper or cardboard stock, although other materials may be utilized.

The first interior panel 14 may include a perforation or score line 52. The perforation or score line 52 provides a means for weakening the fibers of the material which forms the panel 14 and thereby facilitates bending or movement of the panel 14 relative to the panel 20 by folding about the score line 52. Typically, the score line 52 is adjacent the lower edge 44, though the particular position of the score line 52 is not a limiting feature of the invention, and the use of a score line 52 is not a requisite for the brochure construction.

The second interior panel 16 also includes an upper edge 54 and a lower edge 56, a first side edge 58 and a second side edge 60. The second interior panel 16 further includes a top surface or side 62 and a bottom surface or side 64. The second interior panel 16 further has a width and height which is substantially equal, or generally equal to the width and height of all the other panels 14, 18, 20, 22. In a preferred embodiment of the invention the second interior panel 16 is a separate element from the first interior panel 14 and is attached thereto at the upper edges thereof 46 and 54. The second interior panel 16, likewise, may include an optional perforation, or score line 66, which facilitates folding movement of the second interior panel 16.

Figure 3:
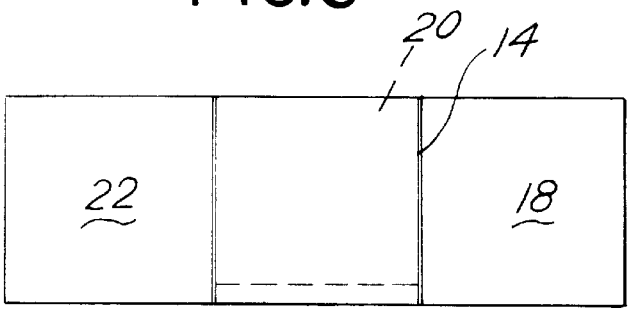
FIG. 3 is a plan view of a partially assembled brochure of the type depicted in FIG. 1.
Figure 4:
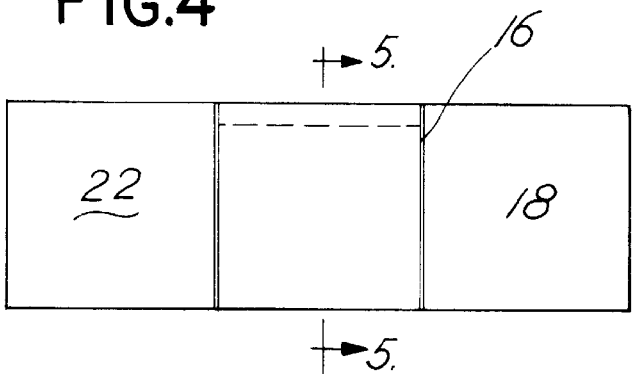
FIG. 4 is a plan view of the assembled brochure of FIG. 1 wherein a carrier sheet is positioned to be folded.
Figure 5:
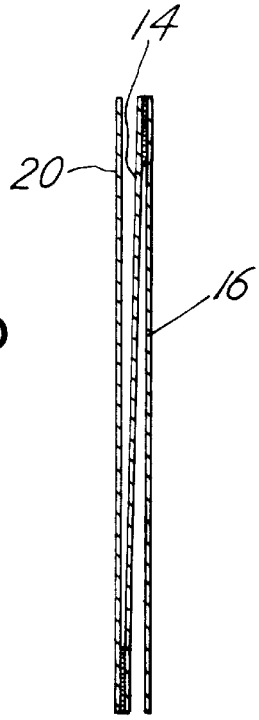
FIG. 5 is a sectional view of the brochure of FIG. 4 taken substantially along the line 5—5.

The upper edge 54 of second interior panel 16 is adhered by means of an adhesive or other fastening or means. Mechanical means may be utilized, but are not generally desired. Staples or other mechanical devices may thus be used as an adhering mechanism. The panels forming the brochure in FIG. 1 are assembled or folded in a manner whereby the first interior panel 14 is juxtaposed immediately over the middle or second carrier sheet panel 20 of the sheet 12. The second interior panel 16 then overlies the first interior panel 14. Thereafter, one of the side panels 18 or 22, either the first panel 18 or the third panel 22, may be folded over the layered interior panels 14 and 16. Then the other remaining panel, either panel 18 or panel 22, may be folded over all of the panels. For example, panel 18 may be folded over panel 22, panel 16, panel 14 and panel 20. The top side 28 of the panel 22 may include spots or a deposit of releasable adhesive 27 or some other fastening mechanism to adhere the panel 22 to the bottom side 30 of the panel 18 adjacent fold line 24. This assemblage of panels and their arrangement, or juxtaposition, one with respect to the other, is illustrated in FIGS. 1–5. Thus, referring to FIG. 2, it is noted that the carrier sheet 12 is divided into the three described carrier sheet panels 18, 20 and 22. Interior panels 14 and 16 are then affixed thereto. Panel 14 is affixed thereto as depicted in FIG. 3. Thereafter, panel 16 is affixed as depicted in FIG. 4. When the assembled panels 20, 14 and 16 are assembled, they provide an array of layered panels as depicted in FIG. 5.

FIGS. 6–16 illustrate the steps associated with assembling the brochure of FIG. 1 from a flat printed web 70 wherein the web 70 may be printed on both sides, or on one side thereof. FIG. 6 depicts an end or cross-sectional view of a typical printed web 70. Thus, web 70 has printing applied to one or both sides using conventional web press printing means, for example, via offset rollers. The web 70 has a lateral extent or dimension 72 which is equivalent to the width of the web 70 and a longitudinal extent or dimension as depicted schematically in FIG. 7 by the longitudinal dimension 74. Longitudinal dimension 74 is substantially an endless dimension for purposes of description of the invention. The top side 28 and/or bottom side 30 of the web 70 are printed and correspond to the top side 28 and bottom side 30 of the sheet 12. Thus, one or both sides 28, 30 may be printed. A finite longitudinal section or unit or dimension 74 of web 70 equal to the height 32 of sheet 12 and the associated lateral dimension 72 of the web 70 is thus printed so as to define the carrier sheet 12 and the associated interior panels 14 and 16. A series of carrier sheets 12 and panels 14, 16 are thus printed arrayed side by side as depicted in FIG. 7. The lateral position of the interior panels 14 and 16 may be reversed in the printing operation. However, it is necessary to have the carrier sheet 12 comprise a single lateral portion of the web 70.

If more than two interior panels 14, 16 are utilized, it is possible to incorporate such panels in the single web printing operation by utilizing a web 70 of greater lateral dimension. Note that the web 70 has a lateral dimension equal to the width 34 of the total number of panels (e.g. 14, 16, 18, 20, 22) which in the described embodiment is five panels. Also, the printing of all adjacent panels is depicted in the drawing. It is not necessary, however, to print all of the panels in adjacent or side by side array. Thus, the printing operation may occur on separate webs. However, it is preferred that the carrier sheet 12 and interior panels 14 and 16 be printed laterally side by side with respect to each brochure which is to be assembled.

After the web 70 is printed, the web 70 is split, or slit, into three separate runs or ribbons 70A, 70B, 70C. One run or ribbon 70A comprises a series of printed carrier sheets 12. A second run or ribbon 70B comprises a series of first interior panels 14. A third run or ribbon 70C comprises a series of second interior panels 16. As depicted in FIG. 8, subsequent to the cutting of the web 70 into the separate runs or ribbons 70A, 70B, 70C, the cut runs or ribbons 70A, 70B, 70C created from the web 70 may be aligned as depicted in FIG. 8. Thus, ribbon 70A comprising carrier sheets 12 will have ribbon 70B comprising first interior panels 14 positioned precisely over the carrier sheet ribbon 70A so that a panel 14 is precisely positioned over a second or center panel 20 of sheet 12. Ribbon 70C comprising second interior panels 16 is similarly precisely positioned over the ribbon 70B so that panel 16 is properly aligned on top of first interior panel 14. This juxtaposition of the runs or ribbons (i.e., panels) may be effected by appropriate alignment or overlapping of the elongated ribbons 70A, 70B, 70C in the longitudinal direction. The component parts that are then aligned one over the other as depicted in FIG. 9 may next be adhered together by adhesive. Next, separate brochures may be formed by a lateral cut across the web 70 to thereby provide that the component parts (sheet 12, first panel 14, second panel 16) of the brochure will be effectively aligned, positioned, adhered together to form a single brochure. The carrier sheet panels 18, 20, 22 may be folded before or after making the lateral cut.

Figure 10:
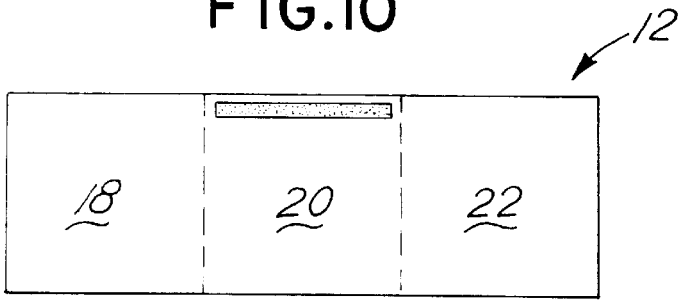
FIG. 10 is a schematic plan view illustrating a further step subsequent to that of FIG. 9 depicting the application of adhesive on an interior panel.
Figure 11:
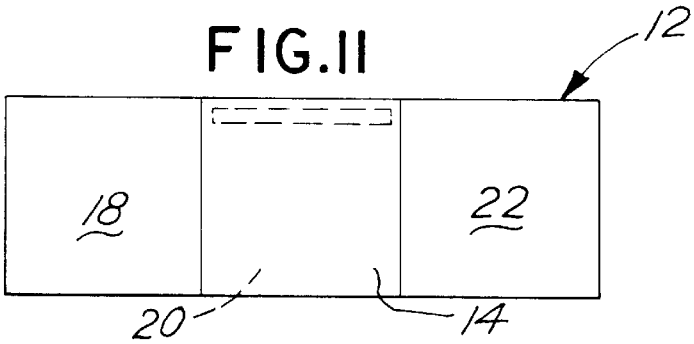
FIG. 11 is a schematic view illustrating a step subsequent to the step of FIG. 10 depicting the assembly of panels.

Prior to joining the panels 14, 16 to sheet 12, as shown in FIG. 10, glue or adhesive is applied in the lateral direction to the upper edge of the second panel 20 and to the bottom edge of the first interior panel 14 on the top or outside surface. Note, the adhesive may be placed on the carrier sheet 12 and the interior panel 14 prior to or after formation of the separate ribbons 70A, 70B, 70C. Also, the adhesive is typically applied to the top or outside or upper face of the ribbons 70A, 70B, 70C in order that the adhesive applications may be positioned on only one side of the web 70. However, this method and step is not a limiting feature of the process. Thus, adhesive may be applied to either side of the web 70, either before or after forming the separate ribbons 70A, 70B, 70C, and either before or after separating the separate sheet 12 and panels 14, 16 from their respective ribbons 70A, 70B, 70C. For purposes of convenience, application of adhesive is effected prior to lateral cutting of ribbons 70A, 70B, 70C to form the sheet 12 and joined panels 14, 16. FIG. 11 illustrates a subsequent step wherein the first interior panel 14 is physically adhered to the carrier sheet 12 and more particularly juxtaposed over the second panel 20.

Figure 12:
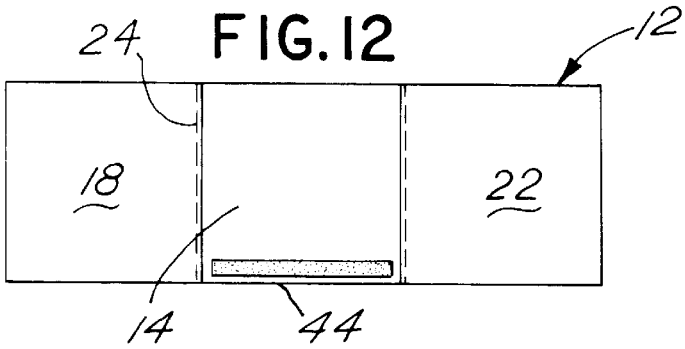
FIG. 12 is a schematic view illustrating a step subsequent to the step of FIG. 11 depicting adhesive application on an interior panel.
Figure 13:
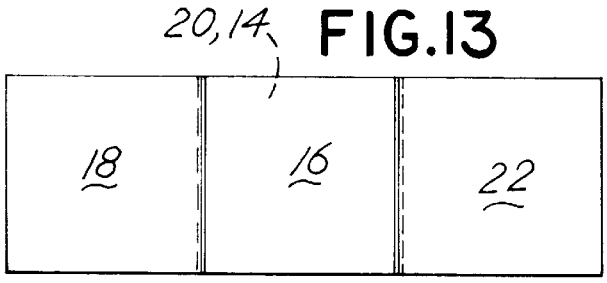
FIG. 13 is a schematic view illustrating a step subsequent to the step of FIG. 12 depicting the assembly of interior panels.
Figure 14:
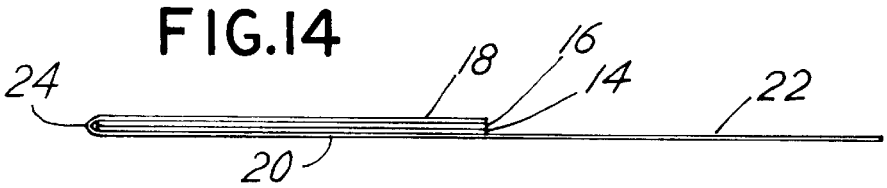
FIG. 14 is a schematic view illustrating a step subsequent to the step of FIG. 13 depicting a folding sequence of panels.

As depicted in FIG. 12, adhesive is also applied to the lower edge 44 of first interior panel 14. Thereafter, the second interior panel 16 is positioned on the first panel so as to be adhered thereto. Thus, both interior panels 14 and 16 are juxtaposed or overlaid and positioned on the second panel 20. Thereafter, the right hand panel or first panel 18, is folded over the interior panels 14 and 16 along the fold line 24 as depicted in FIG. 14. Adhesive 27 is also placed along the outer edge 23 of the third panel 22 as depicted in FIG. 15. Thereafter, as depicted in FIG. 16, the third or outer panel 22 is folded along fold line 26 and over the bottom side 30 of the first panel 18. The folded array is depicted in FIG. 16. Thus, an assembled brochure is available printed on one or both sides of all of the panels forming the brochure and wherein the brochure is compactly assembled and assumes the size of the folded-over panels.

It is to be noted that the number of interior panels 14 and 16 is not a limiting feature of the invention. Thus, additional interior panels may be stacked one upon the other, or overlaid, one upon the other, to be covered by, or retained within, the carrier sheet first panel 18 and third panel 22. The perforation or score lines 44, 66 are typically in the lateral direction. These perforations or score lines 44, 66 serve as a hinge by weakening of the paper fibers and provide a natural fold line when a panel is opened. The degree of perforation and position can be adjusted to accommodate a tear-out feature associated with the interior panels 14 and 16, for example. The size of the panels may be varied. Their length, width and height may be varied. The size of the interior panels and the shape of the interior panels may be varied. The edge of the interior panels which is attached or adhered to the carrier sheet, as well as to respective layers of interior panels, may be varied. The carrier sheet outside panels 18, 22 which fold over the totality of panels may be varied. The preferred method of printing of the web 70 is a web offset method. However, other in-line finishing processes may also be applied to the web 70 before it is cut and assembled. Utilizing this technology, brochures can be mass produced at rates of more than 100,000 units per hour, depending upon the size of the brochure, the format and printing required, the paper or other material being utilized, and the equipment which is utilized.

In addition, it is possible to provide an accordion folded set of interior panels in lieu of separate, adhesive connected panels such as interior panels 14 and 16. Fold lines may thus separate the accordion folded interior panels. The adhesive material is then placed only on one side or edge of the interior panel immediately overlying the middle panel 20 or on the middle panel along a lateral side edge, top edge, or bottom edge.

FIGS. 17 and 18 disclose alternative constructions. In FIG. 17, interior panels 82, 84 include adhesive 86 and 88 along lateral side edges of the panels 82 and 84. FIG. 18 depicts interior panels 90 which are formed by folding a sheet in an accordion-like manner so that a fold line 92 separates adjacent panels 90 and 91. An outer edge of the folded sheet forming the overfolded panels 90, 91 is attached by adhesive to the center panel 20 of the carrier sheet 12. Adhesive may thus be applied to the panel 20 along a side edge thereof to join panels 90, 91 to sheet 12 and the web 70 forming sheet 12 and panels 91, 92 may be simultaneously printed, receive adhesive, then split into ribbons, folded and joined in a high speed, continuous operation. In the event an interior panel sheet is to be attached at a top or bottom edge of a carrier sheet panel 20, processing becomes more complex. Various printing and assembly techniques may be used. For example, the interior panels may be preprinted and folded on an separate web.

As another feature of the invention, the carrier sheet 12, may, for example, be formed on a separate web from the web associated with the interior panels. Thus, there are many variations with respect to the invention. The size and shape of the sheet, the material which is used to make the brochure, the size and type of interior panels, the utilization of perforations, adhesives, single or multiple webs, the positioning of the adhesive connections, and other variations may be adopted in the practice of the invention. The invention therefore is, to be limited only by the following claims and equivalents thereof.

What is claimed is:

1. A multiple panel brochure comprising, in combination:

an outside carrier sheet having first, second and third, side by side panels joined together at fold lines between each panel whereby a first right hand panel, a second central panel and a third left hand panel are formed, the carrier sheet having a top side and a bottom side, said first panel and said third panel being folded over the top side of the second panel and the third panel being folded over the bottom side of the first panel or vice versa, each of said first and third panels including a fold edge adjacent the second panel and an outside edge, each of said carrier sheet panels having a width and a height; and at least one, separate, interior panel attached to the carrier sheet second panel and over folded by the carrier sheet first panel and the carrier sheet third panel, said interior panel having a top side and a bottom side, opposite side edges, a lower edge and an upper edge, and a width substantially equal to or less than the width of the carrier sheet second panel, the interior panel being layered upon the second panel by attachment along a single edge of the interior panel whereby the top side and bottom side of the interior panel may be visually exposed by sequentially unfolding the first panel and the third panel and subsequent unfolding of the interior panel.

2. The brochure of claim 1 wherein the panels are preprinted on the top side or the bottom side or both sides.

3. The brochure of claim 1 including at least two interior panels, arranged in layered sequence.

4. The brochure of claim 1 wherein the panels of the carrier sheet have a generally equal width.

5. The brochure of claim 1 comprising five panels including two interior panels.

6. The brochure of claim 1 wherein the outside edge of the first panel or third panel is adhered to the underside of the third panel or the first panel.

7. The brochure of claim 1 including interior panels, at least two layered, each interior panel having a lower edge, an upper edge and opposite side edges, and wherein one of the upper edge or lower edge of an interior panel is adhered to the top side of the carrier sheet, second panel and an edge of the other interior panel is adhered to the next adjacent layered interior panel.

8. The brochure of claim 1 wherein the interior panel further includes a perforation line along one edge thereof.

9. The brochure of claim 1 where the interior panel includes a perforation line along an edge thereof attached to the carrier sheet second panel.

10. The brochure of claim 1 including multiple interior panels formed by folding a single sheet.

11. The brochure of claim 10 wherein the interior panels are formed, at least in part, by a sheet folded in an accordion fold.

12. The brochure of claim 11 wherein the panels of the accordion folded panels have a substantially equal width.

13. The brochure of claim 1 including a series of interior panels formed by folding a single sheet to form multiple, layered interior panels with one of said interior panels juxtaposed against the carrier sheet, second panel, said one interior panel adhered along one edge thereof to the top side of the carrier sheet, second panel.

14. The brochure of claim 1 comprising multiple interior panels including a fourth panel and a fifth panel, said fourth panel juxtaposed against the carrier sheet, second panel and adhered thereto along one edge thereof, said fifth panel overlying the fourth panel and adhered to the fourth panel along one edge thereof.

15. The brochure of claim 14 wherein the fourth panel has an upper edge adhered to the carrier sheet, second panel.

16. The brochure of claim 14 wherein the fourth and fifth panels have lower edges adhered together.

17. The brochure of claim 14 wherein the fourth or fifth panel includes a perforation adjacent the edge which is adhered to the next adjacent layered panel.

18. The brochure of claim 1 wherein the panels forming the carrier sheet each have a height dimension, said height dimensions being substantially equal.

19. The brochure of claim 1 including two layered interior panels, all of said panels being pre-printed on a single web of printing material and formed into separated panels by cutting said printed web into discrete parts.

20. A multi-panel brochure comprising, in combination:

an outside carrier sheet having first, second and third panels, said first, second and third panels having an equal width and an equal height, said panels joined together along fold lines between adjoining panels whereby a first right hand panel, a second central panel and a third left hand panel are arranged in order, side by side from right to left, the first panel and the third panel defining outside panels, said panels each having a top side and a bottom side, the first panel and the third panels each having an outside edge generally parallel to a fold line, the top side of one outside edge being adhered to the bottom side of an outside panel; and a fourth and a fifth interior panel, said interior panels also each having a width, a height, a top side, bottom side, an upper edge, a lower edge and opposite side edges, the width and height of the fourth and fifth panels being generally equal to the width and height of the panels forming the carrier sheet, the fourth panel immediately overlying the carrier sheet, second panel and adhered thereto along one edge, the fifth panel immediately overlying the fourth panel and adhered thereto along one edge, and the first panel and the third panel overlying the interior panels.

21. The brochure of claim 20 wherein the fifth panel is adhered to the edge of the fourth panel opposite from the edge of the fourth panel which is adhered to the second panel.

22. The brochure of claim 21 wherein the fourth panel is adhered to the second panel along the upper edge of the fourth panel.

23. The brochure of claim 20 wherein at least some of the panels are printed on their top side and bottom side.

24. The brochure of claim 20 wherein one of the fourth panel and fifth panel includes perforations along an edge to permit removal of the panel from the brochure by tearing of the panel along said perforation.

25. The brochure of claim 20 wherein the panels are printed on a web which is subsequently cut to form the panels.

26. The brochure of claim 20 wherein the fourth and fifth panels are integrally connected along a fold line.

27. A method for manufacture of the brochure of claim 1 comprising, in combination, the steps of:

(a) printing on at least one side a web of material having a longitudinal extent and a lateral extent, the printing of carrier sheets provided on the longitudinal extent and a continuous section of the lateral extent and the printing of an interior panel also provided on the longitudinal extent and on an adjacent section to the carrier sheet of the lateral extent;

(b) cutting the web in the longitudinal direction into discrete runs to separate the printed carrier sheet and the printed interior panel into separate longitudinal ribbons;

(c) attaching the panels to the carrier sheet;

(d) folding the carrier sheet; and (e) cutting the web in the lateral direction into discrete carrier sheets and panels.

28. The method of claim 27 comprising the step of overlayment of the ribbons of panels which are attached to the carrier sheet prior to cutting the ribbons in the lateral direction.

29. The method of claim 27 including the step of printing the web on both sides.

30. The method of claim 27 including the step of placing adhesive on a surface of the web to effect attachment of the interior panels to one another and to the center panel of the carrier sheet.

31. The method of claim 30 wherein adhesive is placed on one side of the web.

32. The method of claim 30 wherein the adhesive is placed to alternately affix the head and foot of interior panels to an adjacent panel.

* * * * *